United States Patent [19]

Fritzman

[11] Patent Number: 4,867,455

[45] Date of Patent: Sep. 19, 1989

[54] TWO AND THREE-DIMENSIONAL SQUARE ARRAY, IN-LINE ARRAY, AND GRID TYPE GAME OR PUZZLE

[76] Inventor: Steven F. Fritzman, 38 Mourning Dove Dr., Stafford, Va. 22554

[21] Appl. No.: 137,917

[22] Filed: Dec. 28, 1987

[51] Int. Cl.[4] ..... A63F 9/08

[52] U.S. Cl. ..... 273/156

[58] Field of Search ..... 273/156, 292, 294, 299

[56] References Cited

U.S. PATENT DOCUMENTS

| | | | |
|---|---|---|---|
| 331,652 | 12/1885 | Richards | 273/294 |
| 523,067 | 7/1984 | Ferree | 273/156 |
| 1,354,707 | 10/1920 | Waterhouse | 273/292 X |
| 3,245,687 | 4/1966 | Irwin | 273/295 X |
| 3,759,526 | 9/1973 | Estvan, Jr. | 273/294 |

FOREIGN PATENT DOCUMENTS

| | | | |
|---|---|---|---|
| 2119663 | 11/1983 | United Kingdom | 273/292 |

*Primary Examiner*—Anton O. Oechsle

*Attorney, Agent, or Firm*—Schwartz & Weinrieb

[57] ABSTRACT

A plurality of square-shaped playing pieces (B), which may comprise two-dimensional cards or a face or surface of three-dimensional cubes, are disposed within a square-shaped array (C) so as to define a playing game or puzzle (A). Each playing piece (B) has indicia upon each surface thereof at each corner location, a central peripheral edge location, and a geometric central location such that when the playing pieces (B) are arranged in the array (C) of the first embodiment of the present invention, target lines (D,E) are defined between mating edges of the playing pieces (B), target number (F) are defined at the central portion of the array (C), outside target line numbers (G) are defined along the target lines (D,E) at the central peripheral edge portions of the array (C), inside target line numbers (H) are defined along the target lines (D,E) between the target numbers (F) and the outside target line numbers (G), ring numbers (I) are defined within the corners of the array (C), and the center face numbers (M) are defined at the central portion of each game piece (B). Predetermined relationships between the indicia of the various groups of target numbers (F), inside target line numbers (H), outside target line numbers (G), ring numbers (I), and center face numbers (M) are establised so as to determine winning game combinations or puzzle solutions. In accordance with a second embodiment of the present invention, the game pieces may be arranged in an in-line array whereby indicia disposed in groups along mating or meeting lines (L', L'', L''') are correlated to the center face numbers in order to determine winning game combinations or puzzle solutions. In accordance with a third embodiment of the present invention, grid type playing pieces (100, 200) define indicia which must satisfy predetermined relationships along mating edges (300,400) in order to determine winning combinations or puzzle solutions.

28 Claims, 3 Drawing Sheets

| | | | | | |
|---|---|---|---|---|---|
| 0 | 3 | 4 | 5 | 7 | 4 |
| 2 | (5) | 8 | 0 | (2) | 3 |
| 7 | 1 | 6 | 1 | 6 | 9 |
| 3 | 2 | 2 | 5 | 8 | 0 |
| 5 | (1) | 4 | 3 | (7) | 7 |
| 1 | 1 | 3 | 6 | 2 | 8 |

| | | | | | |
|---|---|---|---|---|---|
| 4 | 6 | 9 | 5 | 3 | 5 |
| 1 | (6) | 8 | 9 | (2) | 0 |
| 3 | 7 | 2 | 3 | 1 | 2 |
| 4 | 3 | 7 | 2 | 4 | 6 |
| 4 | (7) | 2 | 5 | (5) | 9 |
| 5 | 7 | 0 | 1 | 2 | 4 |

| | | | | | |
|---|---|---|---|---|---|
| 7 | 0 | 6 | 5 | 7 | 3 |
| 4 | (5) | 3 | 2 | (8) | 3 |
| 2 | 5 | 1 | 1 | 9 | 8 |
| 0 | 1 | 5 | 2 | 5 | 1 |
| 9 | (4) | 7 | | (3) | 2 |
| 3 | 5 | 3 | 4 | 8 | 4 |

| | | | |
|---|---|---|---|
| (5) | 1 | 4 | (1) |
| 7 | | | 8 |
| 5 | | | 3 |
| (3) | 4 | 5 | (2) |

| | | | |
|---|---|---|---|
| | | 7 | 1 |
| | (4) | | (7) |
| 3 | | | 1 |
| 4 | | | 0 |
| | (1) | | (8) |
| | | 2 | 2 |

FIG. 7
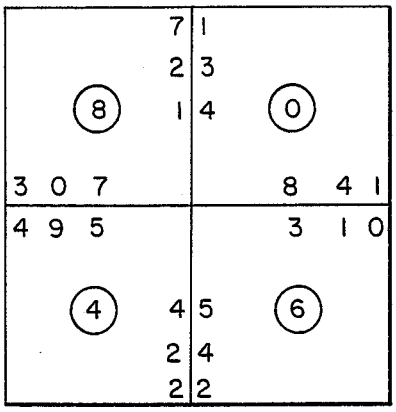
FIG. 8
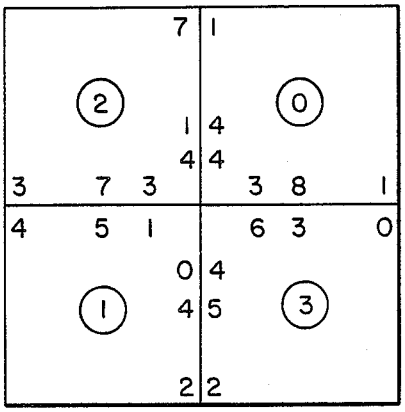
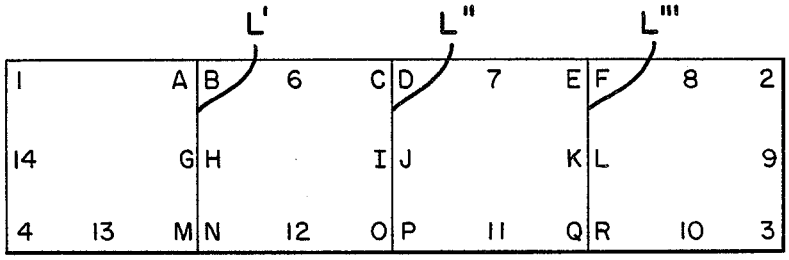
FIG. 9
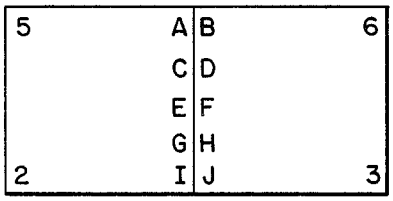
FIG. 10
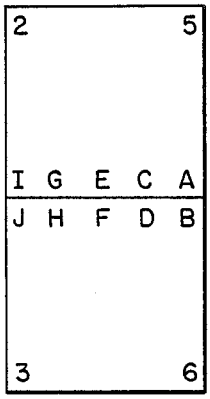
FIG. 11
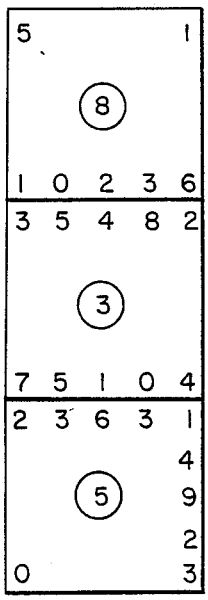
FIG. 14
FIG. 12
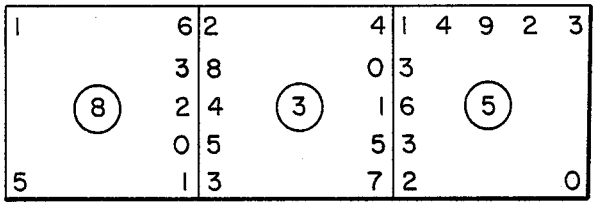
FIG. 13
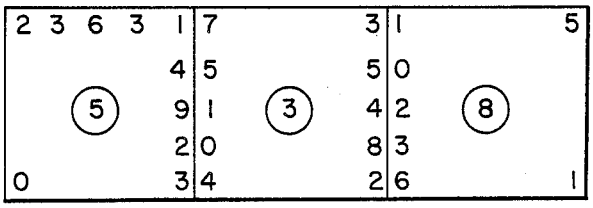

FIG. 15
| | | | |
|---|---|---|---|
| 0 | 3 | 4 | 2 |
| 7 | 4 | 6 | 1 |
| 5 | 2 | 1 | 8 |
100
FIG. 16
| | | | |
|---|---|---|---|
| 1 | 0 | 2 | 5 |
| 3 | 8 | 4 | 3 |
| 4 | 2 | 1 | 6 |
200
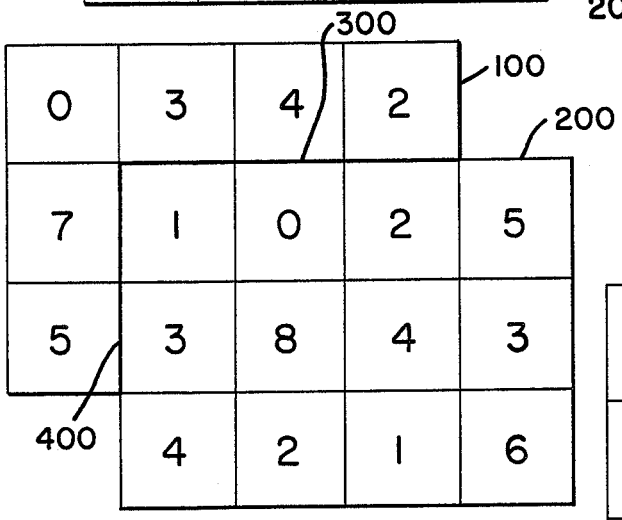
FIG. 17
FIG. 18
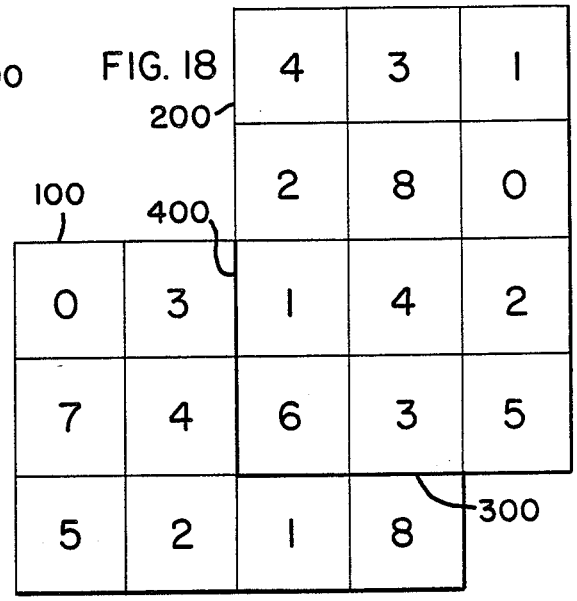
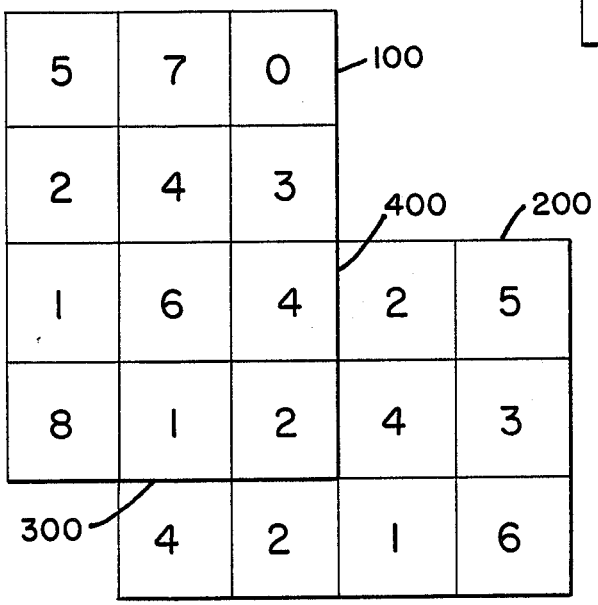
FIG. 19
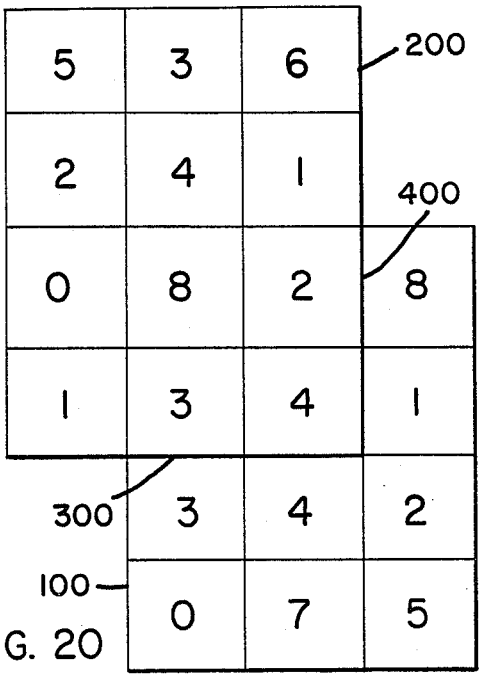
FIG. 20

TWO AND THREE-DIMENSIONAL SQUARE ARRAY, IN-LINE ARRAY, AND GRID TYPE GAME OR PUZZLE

FIELD OF THE INVENTION

The present invention relates generally to game or puzzle type amusement devices, other than jig-saw type puzzles, and more particularly to a two-dimensional game or puzzle type amusement device comprising two or more game or puzzle cards, or a three-dimensional game or puzzle type amusement device comprising two or more game or puzzle cubes, wherein the cards or cubes have various different number or other indicia patterns incorporated thereon at various different locations thereof such that when the cards or cubes are disposed in any one of several different, but correct, orientations or arrangements relative to each other, the indicia patterns satisfy or meet any one of several different predetermined rule or array requirements.

BACKGROUND OF THE INVENTION

Game or puzzle type amusement devices, other than jigsaw type puzzles, wherein a multitude of pieces interact, or are otherwise mutually arranged, with respect to each other such that particular indicia provided upon the pieces are disposed within a particular or predetermined pattern, array, design, or the like, are of course well-known. The provision of the particular indicia upon the game or puzzle pieces, and the arrangement of the pieces with respect to each other, is such, however, that only one combination or arrangement of the game or puzzle pieces, with respect to an extensive number of possible specific orientations or arrangements of the game or puzzle pieces, relative to one another defines the particularly desired or required solution. This fact characteristic of such conventional game or puzzle type amusement devices having only one mode of solution often leads to a marked decline in the popularity of such game or puzzle type amusement devices for the obvious reason that once the player discovers the sole solution to the game or puzzle, or more particularly, once the player has solved the game or puzzle several times, the novelty of the game or puzzle is considerably diminished with the result that the player no longer has a strong interest in, or attraction to, the game or puzzle.

OBJECTS OF THE INVENTION

Accordingly, it is an object of the present invention to provide a new and improved game or puzzle type amusement device.

Another object of the present invention is to provide a new and improved game or puzzle type amusement device which is unique and novel.

Still another object of the present invention is to provide a new and improved game or puzzle type amusement device which, as a result of its novelty and uniqueness, overcomes the disadvantages characteristic of conventional game or puzzle type amusement devices.

Yet another object of the present invention is to provide a new and improved game or puzzle type amusement device wherein the pieces thereof may be arranged within more than one predetermined array or mode so as to attain any one of a several different predetermined solutions to the game or puzzle, in accordance with various different predetermined game or puzzle rules or requirements, whereby the game or puzzle is susceptible of being played a multitude of different times with different objectives or goals to be obtained or achieved such that the play-value and interest by the players with respect to the game or puzzle is considerably enhanced.

Still yet another object of the present invention is to provide a new and improved game or puzzle type amusement device which is relatively simple in its structure and inexpensive to manufacture.

Yet still another object of the present invention is to provide a new and improved game or puzzle type amusement device which requires one to exercise his or her mental facilities in, for example, the performance of addition, subtraction, division, or multiplication computations, in order to attain the goals or objectives of the game or puzzle.

A further object of the present invention is to provide a new and improved game or puzzle type amusement device which will serve as a source of continuous attraction and amusement, and ultimately pleasure, to the player as the player orients the game or puzzle pieces so as to arrange the same within the various relative permutation and combination positions in order to achieve the objectives or goals of the game or puzzle.

SUMMARY OF THE INVENTION

The foregoing and other objectives of the present invention are achieved through the provision of a first embodiment of the game or puzzle type amusement device constructed in accordance with the present invention which comprises a set of four, two-dimensional cards each of which has the configuration of a square, although other geometrical configurations or shapes are possible. Alternatively, in lieu of the four, two-dimensional square-shaped game cards or pieces, a set of eight, three-dimensional cubes may be used and arranged in a two-by-two-by-two array, that is, two cubes wide, two cubes long, and two cubes high, such that each side face or surface of the entire cubical array will, in effect, present a game face or surface which is the same as that developed when employing the two-dimensional cards arranged in a two-by-two array. Each square card or each face of each cube is provided with a dot pattern, or other type of indicia, such as, for example, letters, geometrical shapes, colors, or the like, with the number of dots, in the instance that dots are employed, varying from zero to any upper limit number that may be predetermined when the game is actually constructed, such as, for example, for the purposes of this disclosure, one-hundred, at each corner of the square, at the central position of each edge of the square, and at the center of each square or cube face. Still further, numbered or dot indicia may likewise be provided at peripheral edge positions of each square card or face of each cube which are located between the corner locations and the central edge positions, and still yet further, in the case of employing or using the square-shaped cards, the indicia may be provided upon both surfaces or sides of each square card.

In using the game pieces in order to play the game or amusement device of the present invention so as to solve the puzzle, the four square game cards or playing pieces, or the eight cube game pieces, are arranged in a two-by-two array, or a two-by-two-by-two array, respectively, so as to form an overall square or cube, respectively, and when the game pieces are disposed within such an array, the indicia will, in turn, be disposed at particular positions or locations which are designated in accordance with a specific nomenclature system characteristic of the present invention whereby the game or puzzle may be played or solved according to predetermined rules, requirements, regulations, relationships, or the like. For example, the four numbered dot indicia located at the center of the overall square formed by the two-by-two array of card game pieces, or formed by the two-by-two array of one side surface of the overall cube, are designated the target numbers; the four numbered dot indicia located at the external corners of the overall square of cards or one surface of the overall cube are designated the ring numbers; the eight numbered dot indicia located at the central peripheral edge regions of the overall square or cube face are designated the outside target line numbers; the eight numbered dot indicia located upon the peripheral edge portions of the overall square or overall cube face, but at the center of each edge of each individual square card or individual cube face, are designated the outside center edge numbers; the four numbered dot or numerical indicia located at the center of each individual square card or cube face are designated as the center face numbers; and the remaining eight numbered numerical indicia located within the central regions of the overall card square or square face of the overall cubical array, and between the outside target line numbers and the target numbers, are designated the inside target line numbers. The lines along which the individual square card game pieces or cubical game pieces meet are designated as the target lines, and still further, similar numerical indicia may also be provided along the peripheral edge portions of each individual square card or cube game piece between the corners and the outside center edge numbers so as to be designated inner outside center edge numbers in the case that they are disposed close to a target line, or an outer outside center edge number in the case that they are disposed close to an external corner of the overall square array or face of the overall cube. Remembering that both sides of each individual square card are provided with the numbered dot or other indicia, or that obviously all faces of the cube game pieces are provided with such indicia, when a particular square or cubical array has been established so as to satisfy a particular rule, goal, objective, or the like, of the game or puzzle, so as to potentially serve as a desired solution, in accordance with a further or optional rule of the present invention, the reverse side of the overall card square array, or the opposite side of the cubical array, must likewise satisfy one of the predetermined rules, regulations, relationships, or the like, of the game or puzzle. This is known as the proof of solution. If the reverse or opposite side of the overall square or cube does not satisfy one of the predetermined relationships of the game, then a true solution to the game, or resolution of the puzzle, has not as yet been found.

In accordance with a second embodiment of the present invention, two or more of the square-shaped game pieces or the individual cube-shaped game pieces are arranged in an in-line array comprising at least two game pieces side-by-side, although, of course, a multitude of such game pieces may of course be used, such as, for example, three, four, or more. In this mode of play, the target numbers no longer exist, however, the ring numbers still exist, as well as, of course, the center face numbers, and the mating edges of the game pieces, in lieu of being designated as target lines, are now simply designated as position lines Still further, the various indicia can be grouped together according to their positions along the position lines, and then, of course, the particularly desired relationships between the various groups, and, for example, the center face numbers, can be established.

In accordance with a third embodiment of the present invention, two or more indicia cards, each of which is divided into a plurality of boxes having, for example, numbered indicia within each box, are used in overlapping arrays with the objective being that the opposed or mating edge portions of the cards, and the boxes disposed along such mating edges with the indicia disposed therein, satisfy particular predetermined game relationships, such as, for example, addition, subtraction, multiplication, and division.

BRIEF DESCRIPTION OF THE DRAWINGS

Various other objects, features, and attendant advantages of the present invention will be more fully appreciated as the same becomes better understood from the following detailed description when considered in connection with the accompanying drawings, in which like reference characters designate like or corresponding parts throughout the several views, and wherein:

FIGS. 1–8 represent diagrammatic views of the individual two-dimensional square-shaped card game or puzzle pieces, or in effect, any one two-dimensional face or surface of a three-dimensional cubical array of cubical game or puzzle pieces, when the same are arranged in a two-by-two array, illustrating the various game or puzzle pieces, the indicia provided thereon, and the arrangement or orientation of the same so as to in fact satisfy various different, predetermined relationships between the indicia, or groups or sets thereof, in accordance with the new and improved game or puzzle type amusement device constructed in accordance with a first embodiment of the present invention;

FIGS. 9–14 are diagrammatic views of the two-dimensional square-shaped card, or three-dimensional cube, game or puzzle pieces constructed in accordance with the present invention and as disclosed within FIGS. 1–8, arranged, however, in an in-line array in accordance with a second embodiment of the present invention and illustrating the various different exemplary predetermined relationships that can be developed between the indicia, or groups or sets of indicia;

FIGS. 15–16 are diagrammatic views of two-dimensional grid-type game or puzzle cards or pieces constructed in accordance with a third embodiment of the present invention; and FIGS. 17–20 are diagrammatic views of the game or card pieces of FIGS. 15 and 16, arranged, however, in accordance with various different playing modes so as to satisfy predetermined indicia relationships established in accordance with the present invention.

DETAILED DESCRIPTION OF THE ILLUSTRATED EMBODIMENTS

Figures 1, 2, 3, 4, 5, 6:
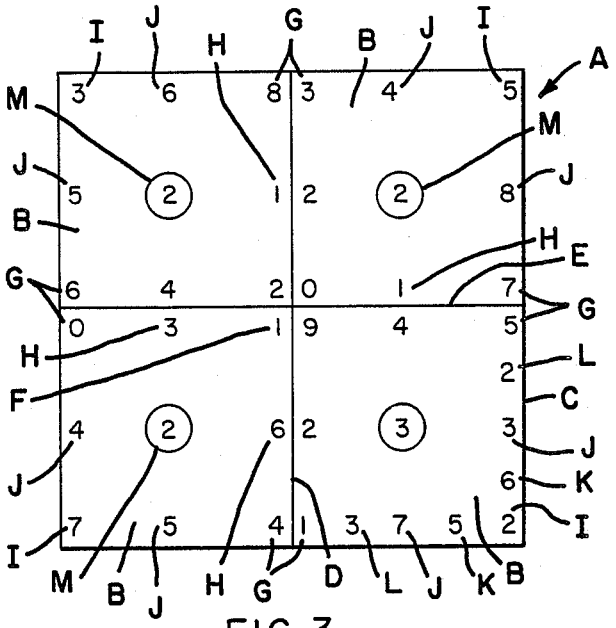

Referring now to the drawings, and more particularly to FIGS. 1–4 thereof, there is shown a first embodiment of the new and improved game or puzzle type amusement device constructed in accordance with the present invention, and which is generally designated by the reference character A. As can readily be seen, the new and improved game or puzzle type amusement device of this embodiment is seen to comprise a set of four square-shaped game playing cards or puzzle pieces B which are adapted to be, in effect, mated together and oriented with respect to each other so as to form a two-by-two square-shaped array, that is, an array which is two cards wide and two cards long, so as to form an overall square C. When the individual game card or puzzle pieces B are in fact arranged within the aforenoted two-by-two array, it is further seen that the cards or game pieces B meet or mate with each other along a pair of mutually perpendicular or orthogonal junctions, much like conventional vertical and horizontal axes of a mathematical graph, which are designated as target lines D and E. It is to be additionally noted at this juncture that while the game or puzzle pieces B have been shown to be squares, other geometrically shaped or configured game or puzzle pieces are possible. In addition, while the game or puzzle pieces B have been described as being two-dimensional cards, for the purposes of the present invention, and the concepts embodied therein, the playing pieces B may likewise be the individual faces or surfaces of cube type playing pieces whereby eight cube playing pieces B can be arranged within a two-by-two-by-two array, that is, two cubes wide, two cubes long, and two cubes high, such that an entire composite face or surface of the overall cube will appear to be virtually identical to the two-dimensional game pieces B of FIGS. 1–4. Consequently, while the following detailed description may in fact describe the playing pieces B as two-dimensional card type playing or puzzle pieces for the sake of simplicity, it is to be understood that the three-dimensional cube-type playing or puzzle pieces, each complete face or side surface of which corresponds to the two-dimensional array of the card type playing pieces, are applicable to the concepts of the present invention.

Continuing further, it is seen that each of the square-shaped playing pieces B is provided with various indicia upon both surfaces or sides thereof at various locations thereof, as will be more fully described hereinafter, but at this junction, it is to be emphasized that the indicia may comprise numbers, a number of dot patterns of a predetermined number of dots as is conventionally known, for example, in the well-appreciated game of dominoes, colors, geometrical symbols or configurations, and the like. For the sake of simplicity, and to enhance the appreciation of the present invention and the game or puzzle concepts embodied herein, the indicia will be noted as numbers, and that is why all non-indicia designations have been made by means of letter reference characters so as not to cause confusion. The actual numbers comprising the indicia may vary from zero to any desired predetermined number which may be determined for the practicality of playing the game or solving the puzzle in accordance with the various relationships to be established between the various indicia, their positions, groups of indicia, and the like, as will become more apparent. In particular, the numerical indicia are provided upon each surface of each game card or piece B at each corner thereof, at each central peripheral edge region thereof, and at each geometric center thereof, all as will be described hereinafter more fully.

When the game or puzzle is played or to be solved, according to the particular rules, relationships, or the like, as will more fully be set forth hereinbelow, the four game cards or pieces B are mated or joined together along the target lines D and E by means of various orientations performed in connection with each of the cards or pieces B so as to in fact satisfy the particular one of the aforenoted game or puzzle rules, relationships, or the like, whereby a solution to the puzzle, or achievement of the game objective, may be accomplished. In particular, it is readily appreciated, for example, that each of the game cards or puzzle pieces B may be rotated in a clockwise or counterclockwise direction so as to bring a particular edge portion thereof into mating or contact engagement with an edge portion of an adjacent game card or puzzle piece, or alternatively, a particular game card or puzzle piece B may be inverted or turned over whereby each of the four edges of such game card or puzzle piece B, with its different numbered indicia at the corners and central peripheral edge regions thereof, may be aligned or mated with the edge portions of adjacent game cards or puzzle pieces B in order to solve the puzzle or win the game.

It is to be further appreciated that when the four game cards or puzzle pieces B are in fact disposed within the aforenoted two-by-two array so as to form the overall square C, some of the numbered indicia locations effectively become altered, and therefore, in order to further the understanding of the present invention, such indicia must be able to be readily identified in an alternative manner and based upon, in effect, the positional location thereof. Along these lines, therefore, all of the indicia locations will now be re-identified with respect to the relative positions of the indicia as viewed within the overall array of square C, and the locations will be designated by means of alphabetic letters or reference characters, and not numbers, so as not to be confused with the actual numerical values of the indicia per se at the particular locations for use in playing the game or solving the puzzle.

In particular, the four numbered indicia appearing at the center F of the entire overall square array C are denoted as the target numbers, while the eight numbered indicia located at the central peripheral edge regions G of the overall square C and located upon the outermost portions of the target lines D and E are denoted as the outside target line numbers. Similarly, the eight numbered indicia located within the central regions of the overall square C, and along the target lines D and E between the outside target line numbers G and the target numbers F are known as the inside target line numbers H. Continuing further, the four numbered indicia located at the corners of the overall square C are known as the ring numbers I, while the remaining eight numbered indicia located upon the peripheral edge portions of the overall square C, but at the center of each exterior edge portion of each individual square card or game piece B, and located between the ring numbers I and the outside target line numbers G, are known as the outside center edge numbers J. As a further option in accordance with the present invention, additional numbered indicia may be provided along peripheral edge positions of the overall square C at locations between the outside center edge numbers J and the ring numbers I so as to be designated outer outside center edge numbers K, as well as at locations defined between the outside center edge numbers J and the outside target line numbers G so as to be denoted inner outside center edge numbers L. For clarity purposes, only some of these numbered indicia are shown in FIG. 1, for example.

The indicia can also be regarded as being divided into portions and sets. For example, the indicia at the corners of the pieces can be regarded as a first portion comprised of a first set (numbers I), a second set (numbers G), a third set (numbers F), and a second portion comprised of a fourth set (numbers M). Numbers H can be regarded as comprising a fifth set.

In accordance with the playing rules of the game or puzzle of this first embodiment of the present invention, various predetermined modes of play or puzzle resolution are possible whereby when play is initiated, one of the predetermined modes of play or puzzle resolution must first be agreed upon. In addition, in order to properly play the game, or solve the puzzle, the particular nomenclature with respect to the denoted indicia must be correctly assured. Consequently, such nomenclature will now be described in connection with such denoted indicia locations.

For example, to determine a target number of a square array C, such that the target number can be properly correlated to the ring numbers, outside target line numbers, inside target line numbers, outside center numbers, or the center face numbers, which are located at the geometric center of each card or puzzle piece B and are denoted at M in FIG. 1, the smallest individual number of the group is initially located and the entire group number is read in a clockwise direction. Therefore, with reference being made to FIG. 1, the target number of FIG. 1 is 0912 because of all the individual numbers comprising the target number or target number group F, the zero is the smallest number, and commencing with that particular number and continuing clockwise about the center of the square array C, the entire target number is 0912. Similarly, the target number of FIG. 2 is 1526, while the ring numbers of FIGS. 1 and 2 would be 2735 and 0481, respectively, it being noted that only FIG. 1 has been provided with the nomenclature reference characters A-M for the sake of clarity within the remaining drawing figures in order to facilitate the ready understanding of the nomenclature system and its application to the actual derivation of the particular target numbers, ring numbers, and the like.

In the event that there are more than one of the smallest individual numbers of a particular number group, and if they are in consecutive order, then the group number is determined by starting with the first one of the same smallest numbers. Consequently, the target number of FIG. 4 is 1125 because the "1" is the smallest number of the entire number group, however, there is more than one "1", and we begin to determine the group number by beginning with the first one of the smallest numbers or, in other words, with the first "1". However, continuing further, if the smallest numbers are not consecutive, then we determine the group number by beginning with the smallest number which is positioned, as considered in the clockwise direction, after one of the common smallest numbers of the entire group. Consequently, the ring number of FIG. 4 would be 4373 because the smallest numbers of the entire group is three, however, there are two of them, and they are not consecutive. The smallest number after either one of the threes is four, so the ring number commences with four and proceeds clockwise. Similarly, the target number of FIG. 3 is 3272 because the smallest common number is two, they are not consecutive, and the smallest number appearing after either one of the twos is three. Consequently, the target number commences with three and proceeds clockwise. Still further, if there are more than one of the smallest numbers which are not consecutive, but the remaining numbers are equal to each other so that, in effect, you might have two pairs of numbers, then to determine the group number you would begin with either one of the smallest numbers. Consequently, as can be seen from FIG. 3, the ring number would be 4545.

Proceeding now to the determination of the outside center numbers, we initially need to determine the ring number because the outside center number has its beginning immediately after the first place digit of the ring number, as read in the clockwise direction. Consequently, with reference being made to FIG. 4, since there are two threes in the ring number positions, we go to the lowest number which appears after one of the threes, as viewed in the clockwise direction, to determine the ring number, and therefore, the ring number is 4373. Therefore, since the four is the first place number or digit of the ring number, the outside center edge number commences with the first number appearing within an outside center edge number position with procession continuing-in the clockwise direction. The first outside center edge number appearing after the four of the ring number is eight, so consequently, the outside center edge number of FIG. 4 is 85940732. In the event that there is more than one of the ring numbers which could assume the first place of the ring group number, such as, for example, in FIG. 3, there are two fours, then we start with one of the fours and proceed, in the clockwise direction, from the smallest number after either one of the fours. Consequently, after the fours are the numbers two and six, so, since two is less than six, we begin with two, and therefore, the outside center edge number of FIG. 3 is 27416309. In the event that, in addition to two of the ring numbers being equal, two of the potentially first outside center edge numbers were equal, then we proceed in the clockwise direction from the equal ring and outside center edge numbers until the smallest one of an outside center edge number is reached. For example, in FIG. 3, if the outside center edge number on the lower horizontal edge of the lower right side card piece was six instead of two, then the lower right and upper left ring numbers would be equal, that is, four, and similarly, the outside center edge numbers, considered in the clockwise direction proceeding from each of the equal ring numbers would also be equal, that is, six. Consequently, further procession is continued from which we see that the upper edge outside center edge number of the upper right card piece is three while the lower edge outside center edge number of the lower left card piece is seven. Consequently, the number three commences the outside center edge number for the entire group, and therefore, the outside center edge number for FIG. 3 is 30967416, a six having been substituted for the two for our illustrative, or more accurately, descriptive, purposes only.

In a similar manner, the target lines may be numerically or sequentially identified in a manner dependent upon the proper identification of the ring numbers. Specifically, the target lines are identified in a clockwise manner proceeding from the first digit position of the ring number. For example, in FIG. 1, since the ring number is 2735, the first place digit of the ring number is two, and therefore, the first target line in FIG. 1 is the one at the lower center position with the outside target line numbers 4,1. Target line two is the left center position with the outside target line numbers 6,0, while target line three is the upper central position with the outside target line numbers 8,3 and the fourth target line is the right central one with the outside target line numbers 7,5. In the event that it is not readily clear what the first place ring number is, such as, for example, in FIG. 3, then the first place outside center edge number will determine the starting point for commencing identification of the target lines. Consequently, in the example of FIG. 3, since the outside center edge number is 27416309, the target line positioned immediately after the first place digit of the outside center edge number, as considered in the clockwise direction, is target line number one, with the remaining target lines following consecutively in the clockwise direction. Thus, in FIG. 3, the target line at the lower central position and with the outside target line numbers 0,1 is target line one, while the target line at the left central position and having the outside target line numbers 3,4 is target line two. Target lines three and four are those with the outside target line numbers 9,5 and 2,6, respectively. However, if the outside center edge number on the lower edge of the lower right card piece of FIG. 3 was six instead of two, then the outside center edge number for the array of FIG. 3 would be 30967416, and thus, the first place digit would be three, whereby the first target line would be at the right central position with the outside target line numbers 2,6. Consecutively numbered target lines would then proceed in the clockwise direction.

As a result of providing the center face numbers M upon the central portion of each one of the card or puzzle pieces B, these center face numbers, as a group, can be correlated to other groups of numbers in establishing the various different relationships which characterize the game or puzzle of the present invention. For example, the center face numbers can represent the difference or sum of the target numbers and ring numbers; or the difference or sum of the target numbers and outside target line numbers and/or inside target line numbers; or the difference or sum of the ring numbers and the outside target line numbers and/or inside target line numbers; or the difference or sum of the outside target line numbers and the inside target line numbers; or the target numbers can represent the sum or difference between the ring numbers and the center face numbers; or the ring numbers can represent the sum or difference between the target numbers and the center face numbers. For example, with reference being made to FIG. 1, the target number is 0912, and the ring number is 2735. Therefore, if a subtractive or difference comparison were to be made between the two numbers, we would obtain a solution as follows:

$$\begin{array}{cccc} 2 & 7 & 3 & 5 \\ \underline{0} & \underline{9} & \underline{1} & \underline{2} \\ 2 & 2 & 2 & 3 \end{array}$$

It is to be noted that in making the subtractive or difference comparison between the numbers, each column of numbers is, in effect, subtracted singularly, that is, the lowest of the two numbers from the highest of the two numbers, as opposed to the entire number 912 being subtracted from 2735. In our mode of operation, 0 is subtracted from 2; 7 is subtracted from 9; 1 is subtracted from 3; and 2 is subtracted from 5. The result 2223 represents the various different center face numbers which, as can be seen from FIG. 1, are precisely correct, and therefore, the array of card game pieces as disclosed in FIG. 1 is in fact a correct solution to the puzzle or game. The above mode of playing the game or puzzle of the present invention is of course only exemplary, and various other permutations and combinations of the various different groups can be established in a predetermined manner. For example, the center face numbers or the ring numbers can represent the difference between or the sum of the target and outside and/or inside target line numbers or the difference between the outside and inside target line numbers; or between the outside and inside target line numbers; or between the target numbers and the inside target line numbers; or between the target numbers and the outside target line numbers; or between the outside target line numbers and the sum or difference between the target numbers and the inside target line numbers; or between the inside target line numbers and the sum or difference between the target numbers and the outside target line numbers The center numbers could also represent the difference between or the sum of the target and ring numbers, or the ring numbers and the outside and inside target line numbers taken alone, or in summation or the difference thereof. Likewise, the ring numbers can represent the difference between or the summation of the target and center face numbers, or the center face numbers and the inside and outside target line numbers taken alone, or in summation, or the difference therebetween, and similarly for the target numbers which could represent the difference between or the sum of the ring and center face numbers; or the outside and inside target line numbers; or the center face numbers and the inside and outside target line numbers taken alone or in summation, or the difference thereof; or the ring numbers and the outside and inside target line numbers taken alone or in summation or the difference therebetween.

We have already seen the correct solution to the game or puzzle with respect to FIG. 1 as established by the relationship between the target number, the ring number, and the center face numbers, however, if the lower right hand card or game piece B of FIG. 1 was rotated 90° in the clockwise direction, the target number would then be 0112, and the ring number would be 3557. Consequently, the subtractive comparison between them would be:

$$\begin{array}{cccc} 3 & 5 & 5 & 7 \\ \underline{0} & \underline{1} & \underline{1} & \underline{2} \\ 3 & 4 & 4 & 5 \end{array}$$

which represent the alleged correct center face numbers. However, since these are not in fact the actual center face numbers of 2, 2, 2, 3, the solution is incorrect and the game or puzzle player knows that a correct solution has not in fact yet been attained with the cards or game pieces B in this particular relative orientation with respect to each other. Similarly, if the objective or mode of playing operation was to arrange the cards or game pieces such that the center face numbers would represent the sum of the ring numbers and the target numbers, then as a result of the following computation:

$$\begin{array}{cccc} 0 & 9 & 1 & 2 \\ \underline{2} & \underline{7} & \underline{3} & \underline{5} \\ 2 & 16 & 4 & 7 \end{array}$$

the center face numbers would have to be 2, 16, 4, and 7.

As a further example of the mode of operational play of the present invention, the center face numbers may represent the difference between the target number and the sum of the outside target line numbers along each target line. For example, as seen from FIG. 3, the target number is 3272, target line one is the lower central position with the outside target line numbers 0,1; target line two is the left central position with outside target line numbers 3,4; target line three is the upper central position with the outside target line numbers 9,5; and target line four is the right central position with the outside target line numbers 2,6. Consequently, a comparison of the target number with the outside target line numbers summed at each target line position, results in the subtractive comparison as follows:

$$\begin{array}{cccc} 3 & 2 & 7 & 2 \\ \underline{1} & \underline{7} & \underline{14} & \underline{8} \\ 2 & 5 & 7 & 6 \end{array}$$

which are precisely the center face numbers of FIG. 3, and therefore, the particularly arranged and oriented cards or game pieces of FIG. 3 represent a correct solution to this game or puzzle. If, instead of a subtractive comparison between the target number and the sum of the outside target line numbers along each target line, it was desired to have the summed comparison of such numbers, then the center face numbers would have to be 4, 9, 21, 10 in order to achieve a correct solution.

As a further example of another mode of operational play according to the present invention, the center face numbers can represent the difference between the outside target line numbers and the inside target line numbers along each target line. With reference to FIG. 2, target line one is the upper central position with the outside target line numbers 4,5 and the inside target line numbers 8,0, while target line two is located at the right central position with outside target line numbers 9,0 and inside target line numbers 6,8. Target line three is located at the lower central position of the overall square C and includes outside target line numbers 3,6 and inside target line numbers 4,3, while target line four is located at the left central position of the overall square C and includes outside target line numbers 7,3 and inside target line numbers 1,2. Consequently, in accordance with this particular mode of operational play or method of solving the puzzle, each outside target line number sum is compared with or subtracted with respect to its corresponding inside target line number sum along the same target line, or in other words, the resulting computations yield from target line one $4+5=9$ for the sum of the outside target line numbers, and $8+0=8$ for the inside target line numbers, with the difference or comparison being $9-8=1$; similarly, for target line two, $9+0=9$, $6+8=14$, and $14-9=5$; for target line three, $3+6=9$, $4+3=7$, and $9-7=2$; and lastly, for target line four, $7+3=10$, $1+2=3$, and $10-3=7$. Consequently, if the center face numbers are to equal the difference between the sums of the outside and inside target line numbers along each target line, then the center face numbers must be 1,5,2,7 which in fact are disclosed within FIG. 2. Therefore, a correct solution to the puzzle or objective of the game has in fact been achieved.

Considering now another example of a different mode of operational play or means to resolve the puzzle of the present invention, it may be desired to have the target number represent the difference between the center face numbers and the ring numbers. With reference being made to FIG. 4, the ring number is 4373 while the center face number is 3458. Consequently, the comparison difference between the two numbers $$\begin{array}{cccc} 4 & 3 & 7 & 3 \\ \underline{3} & \underline{4} & \underline{5} & \underline{8} \\ 1 & 1 & 2 & 5 \end{array}$$

is seen to be precisely the target number 1125. Consequently, the particular arrangement and orientation of the game or puzzle pieces B of FIG. 4 represents a correct solution to the puzzle or game.

A still further variation of the game or puzzle of the present invention may be to arrange and orient the cards or game pieces B so that the sum total of a particular group, which of course would equal a particular number, would be, in turn, equal to the sum total of the numbers of another different group or the sum totals of the numbers of several different groups. For example, in FIG. 2, the sum total of all of the outside target line numbers is seen to be $9+0+3+6+7+3+4+5=37$. Consequently, the puzzle or game requirement may be to arrange the cards or game pieces such that all of the inside target line numbers, when summed together, likewise equals thirty-seven, or similarly for any of the other groups of the game or puzzle.

In accordance with additional variations of the present invention operational mode of play or method of solving the game puzzle, the center face numbers may represent either the difference between the inside target line numbers upon each target line, or the sum of the outside target line numbers upon each target line, or the product of the outer outside center edge numbers, or the quotient of the inner outside center edge numbers, it of course being realized that these are solely provided as examples and that the sum, difference, product, or quotient of any other similar group can also be utilized in playing the game or solving the puzzle of the present invention. Considering then FIG. 5, it is seen that the difference between the inside target line numbers upon each of the target lines is $8-3=5$, $5-4=1$, $7-5=2$, and $4-1=3$, so that the resulting remainders of 5,1,2,3 are precisely the center face numbers of the game or puzzle shown in FIG. 5, and therefore, such represents a correct solution or game achievement. Similarly, if reference is made to FIG. 6, it is seen that the sum of the outside target line numbers along each target line is $1+0=1$, $2+2=4$, $3+4=7$, and $7+1=8$, so consequently, if the center face numbers are 1,4,7,8 then a correct solution to the puzzle or game has been achieved, and this is seen to be the case. Continuing further with reference being made to FIG. 7, the center face numbers may likewise represent the products of the outer outside center edge numbers along each target line. In particular, the products of the outer outside center edge numbers are seen to be $4\times1=4$, $2\times4=8$, $0\times9=0$, and $2\times3=6$, and it is seen that the center face numbers are precisely 4,8,0,6 which therefore represents a correct solution to the puzzle or game. Lastly, with reference being made to FIG. 8, the center face numbers may likewise represent the quotient of, for example, the inner outside center edge numbers which, in the particularly illustrated example, comprise $4/4=1$, $6/3=2$, $0/4=0$, and $3/1=3$, so if the center face numbers are 1,2,0,3, which in fact they are, then a correct solution to the puzzle or game has been achieved.

Considering now a second embodiment of the present invention, in lieu of the two-by-two arrangement disclosed within FIGS. 1–8, the cards or game pieces B may be arranged in a straight line array of at least one card wide and two cards long. As a result of this arrangement, it can readily be appreciated that the target lines per se no longer exist, and therefore, target numbers no longer exist. However, the ring numbers still exist, as do the center face numbers, and the remaining numbers can be arranged in groups along positional lines. Consequently, referring now to FIG. 9, it may be seen that the meeting or mating edges of the cards or game pieces are designated as first line L′, second line L″, and third line L‴. Still further, the various indicia may be grouped together in various different modes so as to be properly identified and used in subsequent game or puzzle operational playing modes. For example, the indicia located along the meeting or mating lines and located at the top of the game pieces or cards may be considered group one, that is, indicia A,B; C,D; and E,F, while group two would comprise indicia in the next row or level, that is, G,H; I,J; and K,L; and group three could comprise the indicia in the next lowest row or level, that is, M,N; O,P; and Q,R. The significance of this classification or nomenclature is that in accordance with one particular mode of play, for example, it may be required that a particular relationship be established between the indicia of the different groups upon the same meeting or mating line. Alternatively, the groups may be designated as being defined upon the same meeting or mating line, so, for example, the indicia of A,B; G,H; and M,N might be considered to be group one, while group two would include the indicia C,D; I,J; and O,P, and group three would include the indicia E,F; K,L; and Q,R. Still yet further, each of the paired indicia upon a particular mating or meeting line can be considered a single group, so consequently, if we were reading left-to-right and top-to-bottom, group one would comprise indicia A,B; group two would comprise indicia C,D; group three would comprise indicia E,F; group four would comprise indicia G,H, with the groups continuing until group nine would comprise the indicia Q,R. Alternatively, the groups may be designated top-to-bottom and left-to-right, so consequently, group one would comprise indicia A,B; group two would comprise indicia G,H; group three would comprise indicia M,N; group four would comprise indicia C,D, and the like, until group nine would be seen to comprise indicia Q,R. It is to be noted at this juncture that while the cards or game pieces have been illustrated as being squares, any other equilateral geometric shape or configuration for the cards or game pieces, having the indicia provided along the edges and in the corners, in a similar manner as that illustrated, can of course be satisfactorily employed.

The indicia in the second embodiment can be regarded as including a first set comprised of the indicia located at the corners of the array of pieces, a second set comprised of at least some of the indicia located along the mating edges of the game pieces of the array, and a third set comprised of the indicia located at the corner of each of the pieces.

In order to properly use the cards or game pieces of the in-line array as disclosed in FIG. 9, the groups must of course be properly identified, and this identification is based upon the existence and proper determination, and orientation, of the ring number. For example, with reference being made to FIG. 10, if in accordance with a particular rule of the game or puzzle, the player is instructed to position the second place ring number or digit of the ring number in the upper left corner, then the cards or game pieces would be arranged as disclosed in FIG. 10 because the ring number is 2563 and therefore, the five is disposed in the upper left corner. Consequently, since the identification of groups always proceeds either left-to-right or top-to-bottom, then for the arrangement of the cards or game pieces of FIG. 10, the indicia A,B would constitute group one, C,D would constitute group two, E,F would constitute group three, G,H would constitute group four, and I,J would constitute group five. However, if the instructions were such that the first number digit of the ring number was to be positioned at the upper left corner location, then the arrangement of the cards would be as disclosed in FIG. 11, and then the indicia I,J would constitute group one, G,H would constitute group two, E,F would constitute group three, indicia C,D would constitute group four, and indicia A,B would constitute group five. These identifications, nomenclature, or classifications are critical to the playing modes of the game or puzzle because the groups of indicia will be related to the center face numbers of the game cards or puzzle pieces, and therefore, proper correlation is essential if the player is to achieve the game objective or solve the puzzle. A playing example is illustrated in FIG. 12.

The ring number of the game or puzzle array of FIG. 12 is 0513, and the player has been instructed to place or position the second place digit of the ring number within the upper left corner of the array. Consequently, the array would actually appear as noted in FIG. 14. The objective of the game or puzzle is to correlate the center face numbers 835 with respect to number groups three, five, and eight such that a sum, difference, product, or quotient of the groups equals the center face numbers. Because the second place ring number five is positioned in the upper left corner, the groups are identified as follows, with the reading of the groups proceeding left-to-right and top-to-bottom, although according to predetermined game rules, the reading may proceed top-to-bottom and left-to-right: group one comprises the indicia 1,3; group two comprises 0,5; group three comprises 2,4; group four comprises 3,8; group five comprises 6,2; group six comprises 7,2; group seven comprises 5,3; group eight comprises 1,6; group nine comprises 0,3; and group ten comprises 4,1. In accordance with the objective of this particular game or puzzle, the product of group three is equal to $2\times4=8$, the quotient of group five is equal to $6/2=3$, and the difference of group eight is equal to $6-1=5$. Therefore, the center face numbers must be 835 which in fact they are, and therefore, the illustrated arrangement and orientation of the cards or game pieces is a correct solution. If the extreme right playing piece or card of FIG. 12 had in fact been rotated 90° in the counterclockwise direction, then the ring number of the array would have been 0251. The second place ring number two would then have to be positioned in the upper left corner of the array per the instructions of the particular game or puzzle, and therefore, all the playing pieces would be rotated around with a consequent change in the group designations to that illustrated in FIG. 13. Group one would now comprise indicia 1,7 as illustrated; group two would comprise indicia 3,1; group three would comprise indicia 4,5; group four would comprise indicia 5,0; group five would comprise indicia 9,1; group six would comprise indicia 4,2; group seven would comprise indicia 2,0; group eight would comprise indicia 8,3; group nine would comprise indicia 3,4; and group ten would comprise indicia 2,6. As can be readily seen, the sum, difference, product, or quotient of group three indicia 4,5 does not equal any of the center face numbers 538, so consequently, this arrangement of the card game pieces is not a correct arrangement or solution to the puzzle.

With reference now being made to FIGS. 15–20, and more particularly, to FIGS. 15 and 16, a third embodiment of the present invention is illustrated wherein the game or puzzle pieces comprise grids or the like as generally indicated by the reference characters 100 and 200. Each of the grid type playing pieces is shown to have a substantially rectangular configuration with the surfaces thereof divided into square-shaped boxes having numerical or other types of indicia thereon, numerical indicia being illustrated for simplicity only. In addition, it is also to be noted that while rectangular game pieces 100 and 200 have been illustrated, the configurations of the game pieces 100 and 200 may comprise other geometrical forms and may be different in size from one another. The sole criteria is that the individual boxes are substantially the same size so as to be capable of being used together in a correlated manner as will become apparent hereinafter. The objective of this game or puzzle is to align the grids such that indicia disposed within particular boxes of the grids define predetermined relationships between mating edges of the grids.

For example, in accordance with the playing mode of this embodiment of the present invention, the grids are to be overlapped or otherwise aligned with respect to each other so that, as is illustrated in FIGS. 17–20, predetermined relationships are defined therebetween. As illustrated in FIG. 17, for example, playing piece 200 is disposed atop playing piece 100 in a partially overlapping mode. The mating edges of the playing pieces as seen at 300 and 400 define opposed groups of indicia along such edges, and it is seen that in accordance with one mode of playing the game or solving the puzzle, all of such groups of indicia must have the same sum total. In particular, $2+2=4$, $4+0=4$, and $3+1=4$ along the mating edge 300, while the groups disposed along the mating edge 400 all have the same sum of eight, that is, $7+1=8$ and $5+3=8$. Consequently, the illustrated disposition of the playing pieces represents a correct solution to the game or puzzle. Alternatively, in accordance with another type of mode of playing the game or solving the puzzle, that is, under a different playing rule or relationship between the opposed indicia along the mating edges of the playing pieces 100 and 200, FIG. 18 illustrates a correct relative disposition of the playing pieces when it is desired to have all of the opposed indicia along a particular mating edge of the pieces define an equal difference or subtraction result. In FIG. 18, it is seen that along mating edge 300, the common difference is five, that is, $6-1=5$ and $8-3=5$, while along mating edge 400, the common difference is two, that is, $3-1=2$ and $6-4=2$. FIG. 19 illustrates a further playing mode wherein the opposed indicia define the same multiplication product along the mating edges. For example, along mating edge 300, the common product is four, that is, $2\times2=4$ and $4\times1=4$, while along mating edge 400, the common product is eight, that is, $4\times2=8$ and $2\times4=8$. Lastly, FIG. 20 illustrates the relative overlapping disposition of the playing pieces wherein a common quotient is defined along the mating edges between the opposed indicia. Along mating edge 300, for example, the common quotient is one, that is, $3/3=1$ and $4/4=1$, whereas along mating edge 400, the common quotient is four, that is, $8/2=4$ and $4/1=4$.

While the aforenoted illustrated modes of playing this game embodiment of the present invention or solving this type of puzzle clearly disclose the variety of the type of operational modes characteristic of the game or puzzle, even further operational or playing modes are of course possible. For example, all indicia along the mating edges may be required to be different, or alternatively, the opposed groups of indicia must be equal to each other along both mating edges, while still further, all opposed groups of indicia must be different from all other groups along one or both of the mating edges.

Obviously, many modifications are possible in light of the above teachings. It is therefore to be understood that within the scope of the appended claims, the present invention may be practiced otherwise than as specifically described herein.

What is claimed as new and desired to be protected by Letters Patent of the United States of America, is:

1. A game or puzzle, comprising:

a plurality of substantially identically configured game pieces interchangeably disposable at predetermined locations with respect to each other, and orientable in any one of a plurality of different orientations at each one of said predetermined locations, so as to form an interrelated array of said game pieces as defined by means of mating edges of said plurality of game pieces so as to form two intersection target lines;

dissimilar indicia disposed at a plurality of locations upon each one of said game pieces, with all of said locations of said indicia upon all of said game pieces defining a pattern which is substantially identical upon each one of said game pieces so as to facilitate said orientations and interchangeability of said game pieces;

a first portion of said indicia being located at each corner of each one of said game pieces so as to define a first set of said indicia at corner regions of said array of said game pieces, a second set of said indicia at outer regions of said array of said game pieces along said target lines, and a third set of said indicia at the central regions of said array of said game pieces; and a second set of said indicia being located at the center of each one of said game pieces so as to define a fourth set of said indicia, wherein said first, second, third, and fourth sets of said indicia are related to each other when said game pieces are disposed at correct ones of said locations, and in correct ones of said orientations, within said array of said game pieces, so as to satisfy at least one of the relationships wherein (1) said fourth set of said indicia is equal to the sum or difference of said third and first sets of said indicia, or (2) said fourth set of said indicia is equal to the sum or difference of said third set of said indicia with respect to the sum or difference of said second set of said indicia along each one of said target lines, or (3) said fourth set of said indicia is equal to the sum or difference of said first set of said indicia with respect to the sum or difference of said second set of said indicia along each one of said target lines, or (4) said fourth set of said indicia is equal to the sum, difference, product, or quotient of said second set of said indicia along each one of said target lines, or (5) said third set of said indicia is equal to the sum or difference of said first and fourth sets of said indicia, or (6) said first set of said indicia is equal to the sum or difference of said third and fourth sets of said indicia, or (7) said first set of said indicia is equal to the sum or difference of said third set of said indicia with respect to the sum or difference of said second set of indicia along each one of said target lines.

2. A game or puzzle as set forth in claim 1, wherein: each one of said game pieces comprises a square.

3. A game or puzzle as set forth in claim 2, wherein: said array of said game pieces comprises a two-by-two array of said square game pieces.

4. A game or puzzle as set forth in claim 2, wherein: said target lines are mutually orthogonal with respect to each other.

5. A puzzle or game as set forth in claim 1, wherein: each one of said game pieces comprises a cube.

6. A game puzzle as set forth in claim 5, wherein: said array of said game pieces comprises a two-by-two-by-two array of said cube game pieces such that any surface of said cubical array of said game pieces comprises a two-by-two array of said game pieces.

7. A game or puzzle as set forth in claim 1, wherein: said indicia comprises numbers.

8. A game or puzzle as set forth in claim 1, additionally comprising:

a fifth set of said indicia provided at peripheral portions of each one of said game pieces between said first portions of said indicia located a said corners of each one of said game pieces.

9. A game or puzzle as set forth in claim 8, wherein: said fifth set of said indicia may be employed in lieu of said second set of said indicia so as to properly satisy an appropriate one of said relationships.

10. A game or puzzle as set forth in claim 8, wherein: when said game pieces are disposed at said correct ones of said locations, and in said correct ones of said orientations, within said array of said game pieces, said sets of said indicia satisy at least one of the following additional relationships wherein (8) said fourth set of said indicia is equal to the sum or difference of said second and fifth sets of said indicia, taken as a group or along each one of said target lines, or (9) said third set of said indicia is equal to the sum or difference of said second and fifth sets of said indicia taken as a group or along each one of said target lines, or (10) said first set of said indicia is equal to the sum or difference of said second and fifth set of said indicia taken as a group or along each one of said target lines.

11. A game or puzzle, comprising:

a plurality of substantially identically configured game pieces interchangeably disposable at predetermined locations with respect to each other, and orientable in any one of a plurality of different orientations at each one of said predetermined locations, so as to form an interrelated array of said game pieces as defined by means of at least one mating edge of said plurality of game pieces;

dissimilar indicia disposed at a plurality of locations upon each of said game pieces, with all of said locations of said indicia upon all of said game pieces defining a pattern which is substantially identical upon each one of said game pieces so as to facilitate said orientations and interchangeability of said game pieces;

a first portion of said indicia being located at each corner of each one of said game pieces so as to define a first set of said indicia at corner regions of said array of said game pieces, and a second set of said indicia at peripheral edge regions of said array of said game pieces along said at least one mating edge of said plurality of game pieces; and a second portion of said indicia being located at the center of each one of said game pieces so as to define a third set of said indicia, wherein said first, second, and third sets of said indicia are related to each other when said game pieces are disposed at correct one of said locations, and in correct ones of said orientations, within said array of said game pieces, so as to satisfy at least one of the relationships wherein in response to a predetermined arrangement of said first set of set of said indicia, (1) the sum of said second set of said indicia equals said third set of said indicia, or (2) the difference of said second set of said indicia equals said third set of said indicia, or (3) the product of said second set of said indicia equals said third set of said indicia, or (4) the quotient of said second set of said indicia equals said third set of said indicia.

12. A game or puzzle as set forth in claim 11, wherein: said first portion of said indicia additionally comprises indicia defined along and peripheral edges of each one of said game pieces between said corners of said each one of said game pieces so as to define additional indicia inclusive within said second set of said indicia.

13. A game or puzzle as set forth in claim 11, wherein: said plurality of game pieces comprises three game pieces.

14. A game or puzzle as set forth in claim 11, wherein: said plurality of game pieces comprising four game pieces.

15. A game or puzzle as set forth in claim 11, wherein: each one of said game pieces comprises a square.

16. A game or puzzle as set forth in claim 13, wherein said array of said game pieces comprises a one-by-three in-line array.

17. A game or puzzle as set forth in claim 14, wherein: said array of said game pieces comprises a one-by-four in-line array.

18. A game or puzzle, comprising:

a plurality of separate game pieces;

indicia grid means defined upon each one of said plurality of game pieces and containing numerical indicia thereon;

said plurality of game pieces being disposed in mating relationship with respect to each other such that said grid means of one of said game pieces is aligned with said grid means of another one of said game pieces along at least one mating edge along which a plurality of grid portions of said indicia grid means of said one of said game pieces is disposed opposite a plurality of grid portions of said indicia grid means of said another one of said game pieces so as to define a plurality of opposed pairs of said indicia along said at least one mating edge, wherein at least one of said opposed pairs of said numerical indicia comprises numerical indicia which are dissimilar with respect to each other and which are dissimilar to said numerical indicia of another one of said opposed pairs of indicia disposed along said at least one mating edge; and wherein said indicia of said one of said game pieces located along said at least one mating edge and disposed within said plurality of grid portions of said indicia grid means of said one of said game pieces is related to said indicia of said another one of said game pieces located along said at least one mating edge and disposed within said plurality of grid portions of said indicia grid means of said another one of said game pieces when said game pieces are disposed in correct mating position with respect to each other so as to satisy at least one of the relationships wherein (1) the sum of each one of said opposed pair of said indicia disposed along said at least one mating edge must be the same, or (2) the difference of each one of said opposed pairs of said indicia disposed along said at least one mating edge must be the same or (3) the product of each one of said opposed pairs of said indicia disposed along said at least one mating edge must be the same, or (4) the quotient of each one of said opposed pairs of said indicia disposed along said at least one mating edge must be the same.

19. A game or puzzle as set forth in claim 18, wherein: said plurality of game pieces comprises two.

20. A game or puzzle as set forth in claim 18, wherein: said indicia grid means of each one of said game pieces comprises a three-by-four grid array.

21. A game or puzzle as set forth in claim 18, wherein: said game pieces are disposed in overlapping relationship with respect to each other such that two mating edges are defined therebetween.

22. A game or puzzle, comprising:

a plurality of substantially identically configured game pieces interchangeably disposable at predetermined locations with respect to each other, and orientable in any one of a plurality of different orientations at each one of said predetermined locations, so as to form an interrelated array of said game pieces as defined by means of at least one mating edge of said plurality of game pieces;

dissimilar indicia disposed at a plurality of locations upon each one of said game pieces, with all of said locations of said indicia upon all of said game pieces defining a pattern which is substantially identical upon each one of said game pieces so as to facilitate said orientations and interchangeability of said game pieces;

a first portion of said indicia being located at each corner of each one of said game pieces so as to define a first set of said indicia at corner regions of said array of said game pieces; and a second portion of said indicia being located at each corner of each one of said game pieces so as to define second and third sets of said indicia at peripheral edge regions of said array of said game pieces along said at least one mating edge of said plurality of game pieces, wherein said first, second, and third sets of said indicia are related to each other when said game pieces are disposed at correct ones of said locations, and in correct ones of said orientations, within said array of said game pieces, so as to satisfy at least one of the relationships wherein, in response to a predetermined arrangement of said first set of said indicia, (1) the sum of said second set of said indicia equals the sum of said third set of said indicia, or (2) the difference of said second set of said indicia equals the difference of said third set of said indicia, or (3) the product of said second set of indicia equals the product of said third set of said indicia, or (4) the quotient of said second set of said indicia equals the quotient of said third set of said indicia.

23. A game or puzzle as set forth in claim 22, wherein: said second portion of said indicia additionally comprises indicia defined along peripheral edge regions of each one of said game pieces between said corners of said each one of said game pieces so as to define additional sets of indicia similar to said second and third sets of indicia which may be related to said second and third sets of indicia in accordance with said at least one of said relationships.

24. A game or puzzle as set forth in claim 22, wherein: said plurality of game pieces comprises two game pieces.

25. A game or puzzle as set forth in claim 22, wherein: said plurality of game pieces comprises four game pieces.

26. A game or puzzle as set forth in claim 22, wherein: each one of said game pieces comprises a square.

27. A game or puzzle as set forth in claim 24, wherein: said array of said game pieces comprises a one-by-two- in-line array.

28. A game or puzzle as set forth in claim 25, wherein: said array of said game pieces comprises a one-by-four in-line array.

* * * * *